US008702828B2

(12) United States Patent
Schultink et al.

(10) Patent No.: US 8,702,828 B2
(45) **Date of Patent: *Apr. 22, 2014**

(54) FLAT BAG FOR VACUUM CLEANERS

(75) Inventors: Jan Schultink, Overpelt (BE); Ralf Sauer, Overpelt (BE)

(73) Assignee: Eurofilters Holding N. V., Overpelt (BE)

( * ) Notice: Subject to any disclaimer, the term of this patent is extended or adjusted under 35 U.S.C. 154(b) by 46 days.

This patent is subject to a terminal disclaimer.

(21) Appl. No.: 13/377,668

(22) PCT Filed: May 17, 2010

(86) PCT No.: PCT/EP2010/003018

§ 371 (c)(1),
(2), (4) Date: Feb. 16, 2012

(87) PCT Pub. No.: WO2010/145740

PCT Pub. Date: Dec. 23, 2010

(65) Prior Publication Data

US 2012/0272628 A1 Nov. 1, 2012

(30) Foreign Application Priority Data

Jun. 19, 2009 (EP) ..... 09008064

(51) Int. Cl.
*B01D 46/02* (2006.01)

(52) U.S. Cl.
USPC ..... 55/309; 55/367; 55/368; 55/372; 55/374; 55/382; 55/486; 55/DIG. 2; 55/DIG. 5; 15/347; 15/352; 15/353; 96/222; 96/223; 96/226; 96/227

(58) Field of Classification Search
USPC ..... 55/309, 367, 368, 372, 374, 382, 486, 55/DIG. 2, DIG. 5; 15/347, 352, 353; 96/222, 223, 226, 227
See application file for complete search history.

(56) References Cited

U.S. PATENT DOCUMENTS

| | | | | |
|---|---|---|---|---|
| 2,732,911 | A | 1/1956 | Gall | |
| 6,063,171 | A | 5/2000 | Moyher, Jr. et al. | |
| 8,066,803 | B2 * | 11/2011 | Sauer et al. | 96/223 |
| 8,092,562 | B2 * | 1/2012 | Sauer et al. | 55/367 |
| 8,236,078 | B2 * | 8/2012 | Rosemeier et al. | 55/382 |
| 8,372,174 | B2 * | 2/2013 | Schultink et al. | 55/365 |
| 8,449,639 | B2 * | 5/2013 | Sauer et al. | 55/367 |
| 2009/0301043 | A1 | 12/2009 | Rosemeier et al. | |

FOREIGN PATENT DOCUMENTS

| | | |
|---|---|---|
| DE | 20 2006 016 304 | 12/2006 |
| DE | 20 2006 016 303 | 1/2007 |
| DE | 20 2006 019 108 | 3/2007 |
| DE | 20 2007 010 692 | 11/2007 |
| DE | 10 2006 051 117 | 1/2008 |
| DE | 20 2008 003 248 | 6/2008 |
| DE | 20 2008 007 717 | 9/2008 |

(Continued)

*Primary Examiner* — Frank Lawrence, Jr.
*Assistant Examiner* — Minh-Chau Pham
(74) *Attorney, Agent, or Firm* — Fay Kaplun & Marcin, LLP

(57) ABSTRACT

A flat bag is for vacuum cleaners. The bad includes, in the interior thereof, at least one diffuser which forms an intermediate plane and is made of strips of material and/or sheet materials with oblong-shaped flow openings. Such flat bags are distinguished by excellent dust storage capacity and extension of the useful life.

26 Claims, 12 Drawing Sheets

(56) References Cited

FOREIGN PATENT DOCUMENTS

| | | |
|---|---|---|
| DE | 20 2008 008 989 | 10/2008 |
| EP | 0 960 645 | 12/1999 |
| EP | 1 787 560 | 5/2007 |
| EP | 1 795 247 | 6/2007 |
| EP | 1 804 635 | 7/2007 |

* cited by examiner

FLAT BAG FOR VACUUM CLEANERS

FIELD OF INVENTION

The present invention relates to a flat bag for vacuum cleaners, which has, in the interior thereof, at least one diffuser which forms an intermediate plane and is made of strips of material and/or sheet materials with oblong-shaped flow openings, Such flat bags are distinguished by excellent dust storage capacity and extension of the useful life.

BACKGROUND INFORMATION

The increase in dust storage capacity—i.e. extension of the useful life (lifespan)—of a vacuum cleaner filter bag is, in addition to improved separation power (particle retention), a substantial aim in the development of filter bags.

This can be achieved by innovative bag materials or also by the incorporation of material surfaces which influence the airflow in the filter bag. Thus EP 0 960 645 and EP 1 795 247 disclose nonwoven materials for vacuum cleaner bags having particularly good dust storage capacity.

EP 1 787 560 shows flow distributors in the form of squares or strips of material which are fitted in the region of the inlet opening of the filter bag and are able to split and deflect the incoming airflow into partial flows. In EP 1 804 635, the concept is developed with respect to a second flow distributor supplementing the function of the first flow distributor. From DE 20 2008 008 989 and DE 20 2008 003 248, combinations of two flow distributors with a spacing means are known.

From DE 20 2006 016 303, a filter bag which comprises a bag having an interior which is subdivided into at least two chambers is known. In the case of one embodiment, the subdivision is effected by a separating wall which is fixed at three side edges, a transition between the first and the second chamber being formed at the fourth side edge. In another embodiment, the separating wall is welded to the filter layers only at one side edge for the entire length and is welded on the opposite side to a strip on the upper layer made of filter material.

DE 20 2008 007 717 describes a filter bag in which a planar, multilayer filter insert which is connected at least partially to the filter bag walls is disposed in the interior. Dust is intended thereby to be incorporated between the at least two layers of the filter insert. For this purpose, the upper of the two layers can be perforated or slotted. The filter insert can be configured as a continuous strip which is fixed at two oppositely situated edges of the bag.

DE 20 2007 010 692 relates to a filter bag in which a filler layer made of fibre- or yarn material extends between the two filter walls, which layer is connected to both filter walls and, when the bag is unfolded, is pulled apart such that a net-like structure is produced in the bag.

A dust filter bag having a blocking wall part fitted in the interior is known from DE 20 2006 019 108. This blocking wall part is mounted in front of the inlet opening of the bag such that it bulges out during operation and forms two outlet openings through which the airflow is deflected. It is essential to the invention that the blocking wall part is mounted at a spacing relative to the bag seam and does not abut against the rear bag wall under the pressure of the airflow.

A further air distributor is known from DE 10 2006 051 117. At least two material layers are thereby disposed one above the other between the bag walls, the layers having less extension in a first surface direction than the two bag walls and, in the surface direction orthogonal to the first surface direction, having the same extension as the bag walls. There may be mentioned as materials, microfibre nonwoven or paper.

DE 2006 016 304 discloses a bag having at least one guide element, by means of which the incoming airflow can be deflected. The guide element is fixed adjacent to the inflow opening.

A bag already found on the market of the company Miele has an arrangement of a deflection device which is fitted directly below the inlet opening. This deflection device consists of a sheet material which is fitted directly with the upper side of the bag on both sides of the inlet opening. The purpose of this deflection device resides in deflecting the airflow which is suctioned in through the inlet opening directly in the region of the inlet opening. This deflection device is configured such that it is welded directly to the bag wall at a spacing relative to the inlet opening on the basis of a prescribed length or area. The area of this deflection device is therefore below approx. 10% of the bag surface. This filter bag is sketched in FIG. 3. However, it is problematic with these bags that, because of the relatively small dimensioning of the first deflection device (SR1), the result can be blockages of the bag due to dust accumulating between the inflow opening and the deflection device so that the bag becomes unusable. In addition, this vacuum cleaner bag also has a second plane of flow directors.

It is however common to all the previously mentioned vacuum cleaner bags that the inflowing dirt particles are only distributed inadequately so that the result is premature blockage of the vacuum cleaner bag, which ultimately leads to reduced dust storage capacity and a clearly inadequate lifespan of the vacuum cleaner bag.

SUMMARY OF INVENTION

The present invention relates to a vacuum cleaner filter bag which ensures increased dust storage capacity and hence an extension of the useful life (lifespan). In addition, blockage of the inlet opening in the interior of the bag is intended to be prevented.

According to the invention, a flat bag having a bag upper side and a bag underside is hence provided, the bag walls of which are formed from an air-permeable filter material and an inlet opening for the air to be filtered being introduced in the bag upper side, in which at least one diffuser which forms an intermediate plane is disposed in the interior of the flat bag between the bag upper side and the bag underside and consists of at least two individual strips of material and/or sheet materials, disposed next to each other, which have oblong-shaped flow openings, the at least one diffuser being connected to the bag wall at least on one side.

The diffusers which are formed from strips of material or sheet materials provided with flow openings thereby cause turbulence of the inflowing air which is laden with dirt and/or dust particles. Hence the lifespan of the bag can surprisingly be substantially extended.

Hence the flat bags according to the present invention include at least one diffuser in an intermediate plane for turbulence of the suctioned-in dust particles. According to the invention, there is understood by this intermediate plane, a curved or uncurved surface which is disposed between the bag upper side and underside forming the bag wall. The intermediate plane in the sense of the invention is hence defined by the arrangement of the diffuser in the interior of the filter bag by connecting the diffuser at at least 1 point of the bag wall.

The diffuser made of a floppy material is thereby formed either from at least two strips of material, disposed next to each other, but can also consist of sheet materials which have flow openings in the sense of slots within these sheet materials. Such sheet materials hence have at least one slot or a cut which however is not impressed continuously over the entire sheet material so that, at the ends of the sheet material, i.e. wherever there is no slotting, cohesion of the sheet material is ensured. The geometric shape of the strips of material or the geometric shapes formed by the flow openings on the sheet material is thereby essentially irrelevant; thus the strips of material can for example be structured as strips or the sheet materials by straight slots, however likewise all other possible geometric shapes of strips of material or sheet materials are possible, for example also s-shaped strips or slot guides, but also through-openings etc.

Preferably there are excluded embodiments of the flat bag in which the diffuser in the form of sheet materials with oblong-shaped flow openings is disposed in the first plane directly below the filter bag upper side in the region of the inlet opening, this diffuser being mounted on the bag upper side on both sides and the area thereof being less than 10%, relative to the total bag surface, the width of the strips of material defined by the slots, relative to the diameter of the inflow opening, being defined at ±50%. In the case of this preferably excluded embodiment of the flat bag, the diffuser is therefore shorter than the total length or width of the flat bag. Both ends of the diffuser configured as a slotted sheet material are fixed directly on the bag upper side. The diffuser thereby covers the inlet opening completely.

It was found surprisingly that the filter bags have an excellent dust storage capacity and hence an increased lifespan. It can likewise be observed that blockages in the region of the air inlet of the bag—as can frequently be the case in the bags known from the state of the art according to FIG. 3—could be avoided.

In an advantageous embodiment according to the invention, the strips of material are disposed moveably relative to each other; it is likewise possible that the strips of the material are at a spacing relative to each other or that the flow openings of the sheet materials are dimensioned such that the resulting strips of material are at a spacing relative to each other.

It is further preferred that the width of the strips of material is 2 mm to at most 50% of the width of the bag upper side. Particularly preferred widths of the strips of material are thereby of orders of magnitude between 5 and 35% of the width of the bag. The same applies for the arrangement of the oblong flow openings relative to each other in the sheet materials, the flow openings defining the width of the strip.

It is further advantageous if the oblong-shaped flow openings of the sheet materials are linear. However, almost any geometric shapes are possible for the oblong flow openings, thus the flow openings can for example have a parallel or meandering or zigzag configuration, furthermore helical lines are likewise conceivable.

In a further advantageous embodiment, the linear, oblong flow openings have a different length within the sheet material. This embodiment of the invention is useful when at least two flow openings are present on the sheet material. These flow openings can thereby have a different length, which leads to improved stability of the diffuser.

It is likewise preferred that the at least one diffuser is mounted on the bag wall on both sides. In this embodiment, the diffuser is hence fixed respectively on the bag upper side or bag underside. Fixing is thereby effected preferably respectively in the end region of the diffuser so that this is connected merely at points to the bag wall and is flexible in the region situated therebetween because of the floppy material and can be moved by the inflowing air.

It is likewise advantageous if the diffuser has approximately the same length and/or width as the bag upper- or underside. Fixing of the diffuser in this case can be effected then expediently by introducing the ends of the diffuser between the upper- and underside of the filter bag and fixing them together with the upper- and underside to form the finished bag. Fixing of the diffuser is thereby effected therefore at the same time as the gluing or welding step for the production of the filter bag itself. In this respect, this possibility for the fixing enables an extremely economical and simple production of the filter bag.

As an alternative embodiment hereto, it is however likewise possible that the diffuser is narrower and/or shorter than the bag upper- or underside. It is further possible here that the diffuser has a greater length and/or width than the bag upper- or underside and is present folded. Folding of the diffuser is effected expediently when the length of the diffuser is greater than the dimensioning of the length and/or width of the filter bag. Folding is then effected expediently in zigzag form, for example partial overlapping of the strips of the diffuser one above the other being effected with a diffuser in strip shape. In this respect, an increase in the engagement surface for the inflowing air is made possible, which leads to a further improvement in the properties of the filter bag.

A further embodiment of the present invention provides that the diffuser in the form of strips of material is configured turned and/or twisted. Here also, an increase in the engagement surface for the inflowing air is effected, the same advantages resulting as were described already in the folded shape of the diffuser.

It is likewise preferred that the diffuser in the form of strips of material is formed by filament bundles or bundles of foil strips. In this embodiment, the strips of material themselves are formed from a large number of filaments or threads or the like.

Likewise, at least two diffusers respectively in the intermediate plane can be disposed respectively relative to each other such that the strips of material and/or the oblong flow openings are not disposed parallel to each other, e.g. orthogonally, but also in arrangements deviating herefrom. With such an embodiment, the airflows entering into the filter bag can be made to swirl specifically.

The floppy materials of the diffuser thereby consist preferably of air-permeable materials and/or of air-impermeable materials. There are considered thereby as air-impermeable materials, in particular foils, for example plastic material foils (e.g. PE or PP). There are used as air-permeable materials, preferably laminates of air-permeable materials and/or air-impermeable materials provided with flow openings.

Furthermore, it is preferred if the diffuser is connected to the bag wall via an adhesive point and/or weld points.

In a further preferred embodiment, the flat bag is formed by two webs made of the filter material which are welded together in the edge region.

The flat bag can thereby be configured in any geometric shapes, in particular square, hexagonal or octagonal configurations are hereby possible.

It is likewise preferred if the diffuser is connected to the edge region of the flat bag.

In particular, the present flat bag according to the invention is a side-folded bag. The diffuser is hereby preferably connected to the side fold of the flat bag.

Further advantages result if the inside of the filter bag upper side has a foil (e.g. a PE foil) in the region of the air inlet opening. This foil can be glued or welded for example. As a result, dust accumulations in the region of the inlet opening can be almost completely avoided during operation so that the closing function of the flap closing the inlet opening is not impaired.

The filter bags used in the examples are represented for illustration of the arrangement of the diffusers in the interior in the subsequently illustrated Figures. The bags are thereby observed in projection with a view on the bag upper side from the bag underside. Provided nothing else is indicated, all the diffusers are formed from strips of a three-layered nonwoven material. In the following descriptions of the Figures, an arrangement of the diffusers "longitudinally" means a vertical arrangement of the diffusers represented in the Figures, whilst "transversely" means a horizontal arrangement of the diffusers inside the filter bag. A differentiation in this respect is necessary since the inlet opening is disposed asymmetrically relative to the centre of mass of the filter bag.

DETAILED DESCRIPTION

Figure 1:
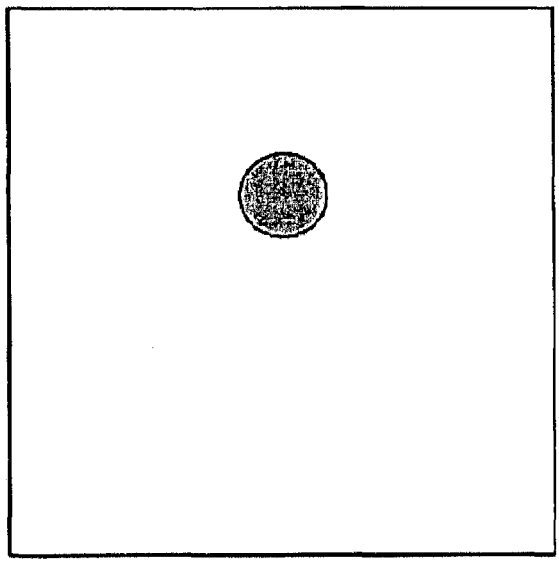
FIG. 1 shows a filter bag without diffusers in the interior (comparative example 1*).
Figure 2:
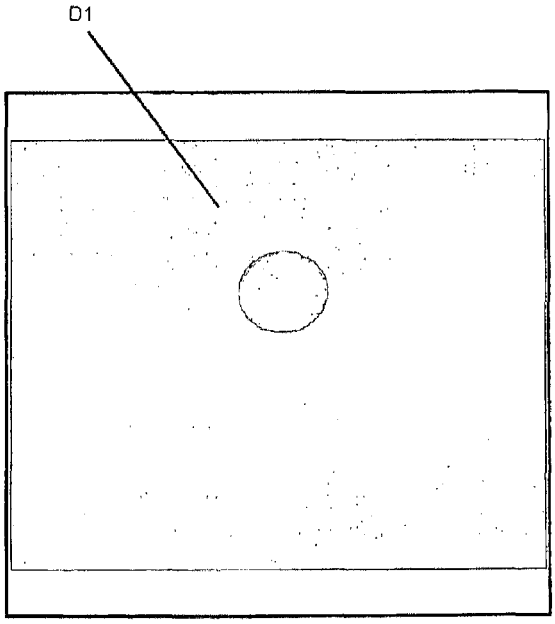
FIG. 2 shows a filter bag which contains an additional continuous nonwoven layer (270 mm width) (not according to the invention, comparative example 2*). The layer D1 is thereby mounted continuously on two edges.
Figure 3:
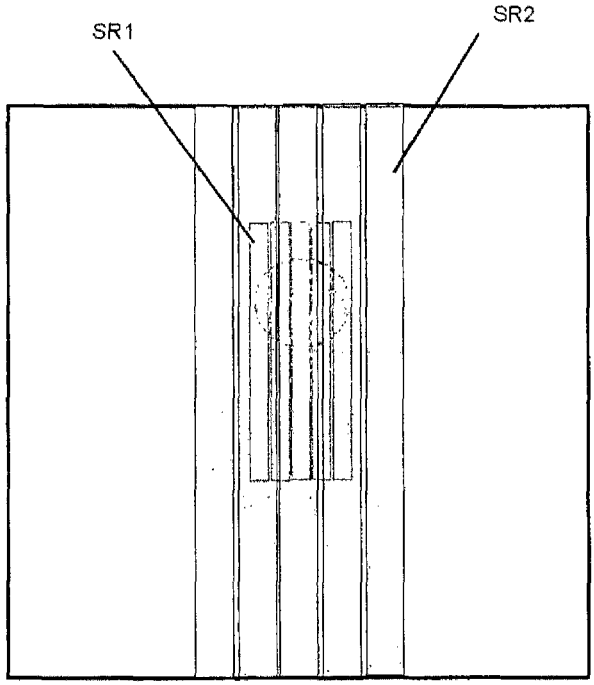
FIG. 3 shows the initially mentioned filter bag having two flow directors SR1 (5×15 mm foil) and SR2 (5×25 mm nonwoven), both flow directors being disposed longitudinally in the filter bag.
Figure 4:
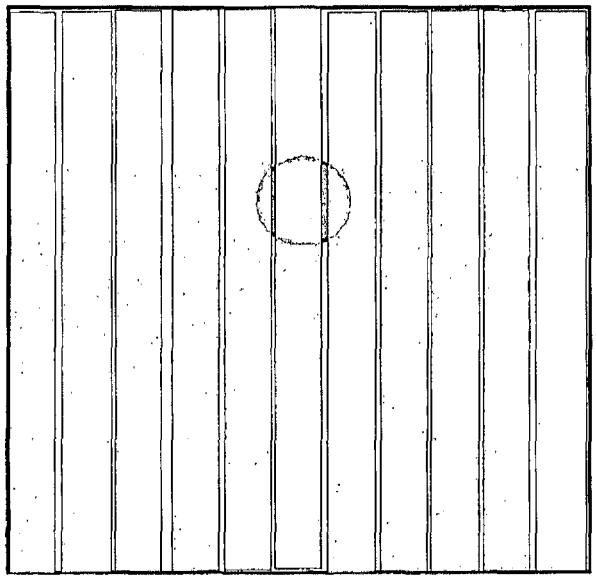
FIG. 4 shows a filter bag according to the invention with a longitudinally disposed diffuser (11×22 mm) (example 4).
Figure 5:
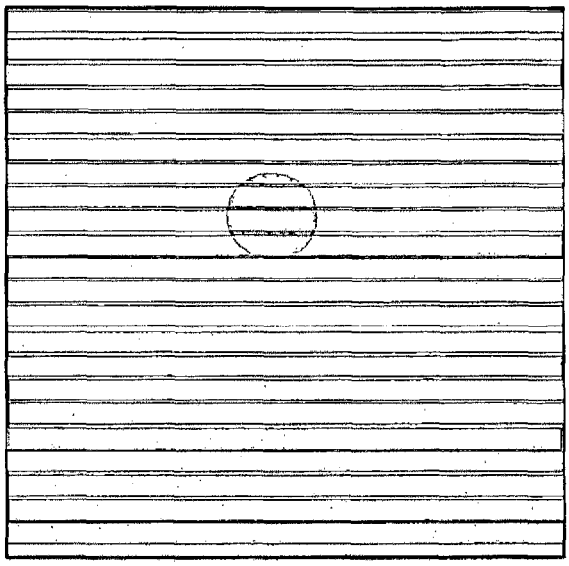
FIG. 5 shows a filter bag according to the invention with a transversely disposed diffuser (22×11 mm) (example 5).
Figure 6:
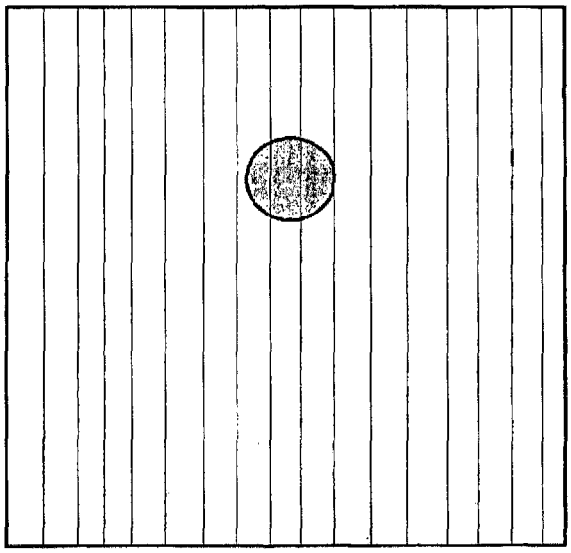
FIG. 6 shows a filter bag according to the invention with a diffuser formed from polypropylene filaments (example 6).
Figure 7:
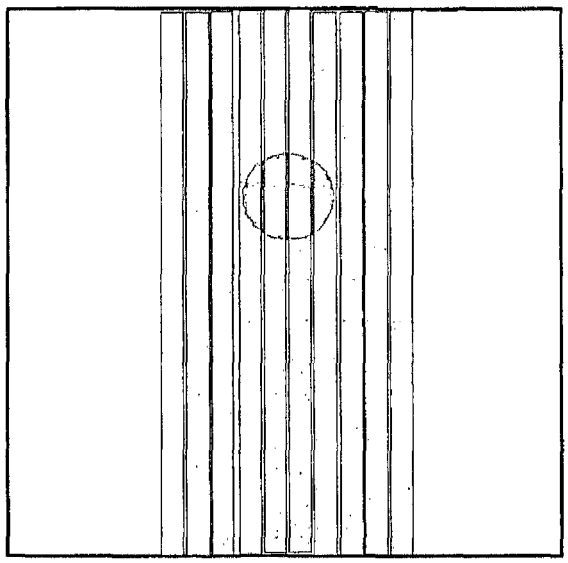
FIG. 7 shows a filter bag according to the invention with a longitudinally disposed diffuser (10×11 mm) (example 7).
Figure 8:
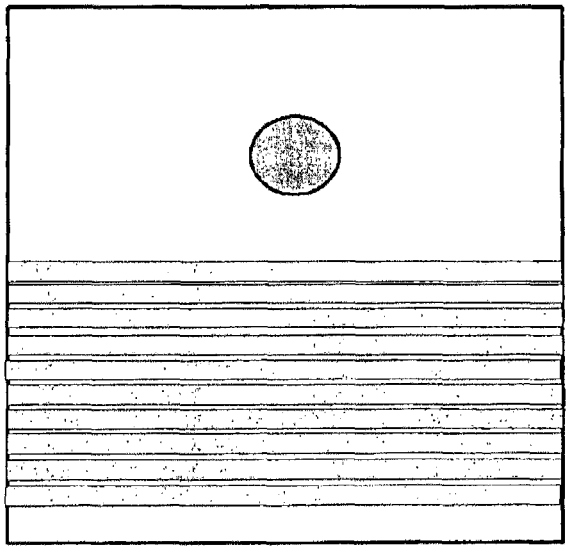
FIG. 8 shows a filter bag according to the invention with a transversely disposed diffuser (10×11 mm) (example 8).
Figure 9:
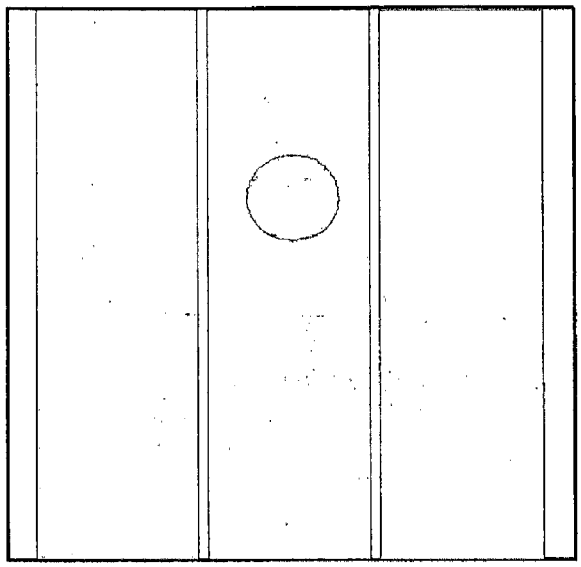
FIG. 9 shows a filter bag according to the invention with a longitudinally disposed diffuser (3×90 mm) (example 9).
Figure 10:
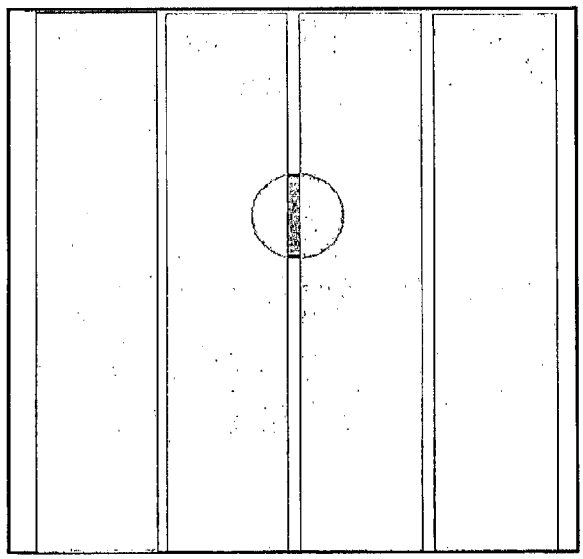
FIG. 10 shows a filter bag according to the invention with a longitudinally disposed diffuser (4×67.5 mm) (example 10).
Figure 11:
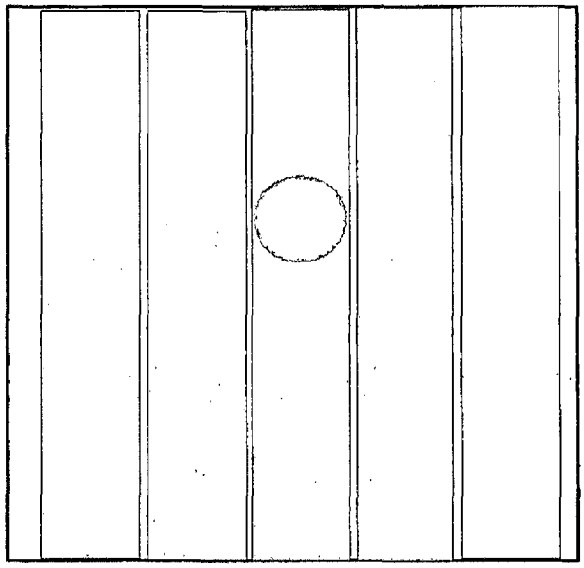
FIG. 11 shows a filter bag according to the invention with a longitudinally disposed diffuser (5×54 mm) (example 11).
Figure 12:
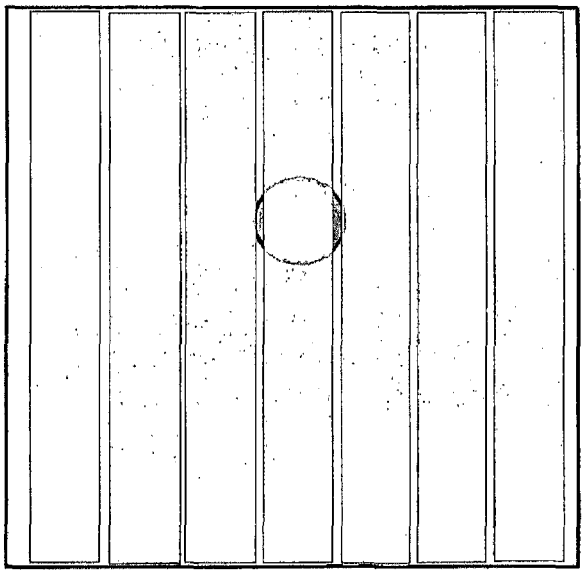
FIG. 12 shows a filter bag according to the invention with a longitudinally disposed diffuser (7×38 mm) (example 12).
Figure 13:
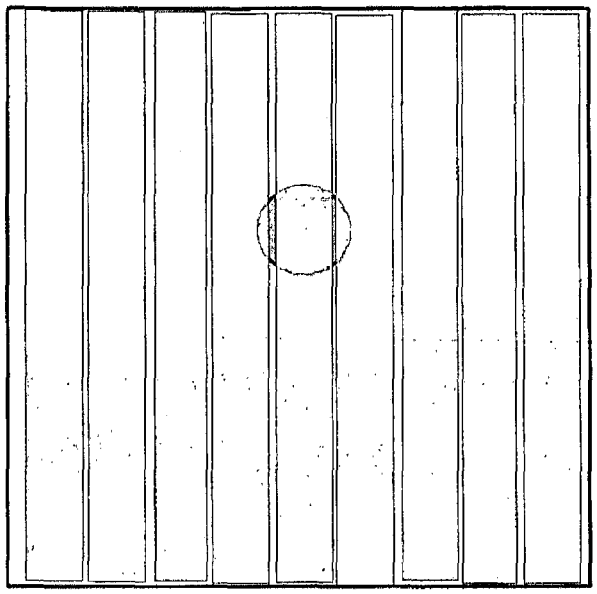
FIG. 13 shows a filter bag according to the invention with a longitudinally disposed diffuser (9×30 mm) (example 13).
Figure 14:
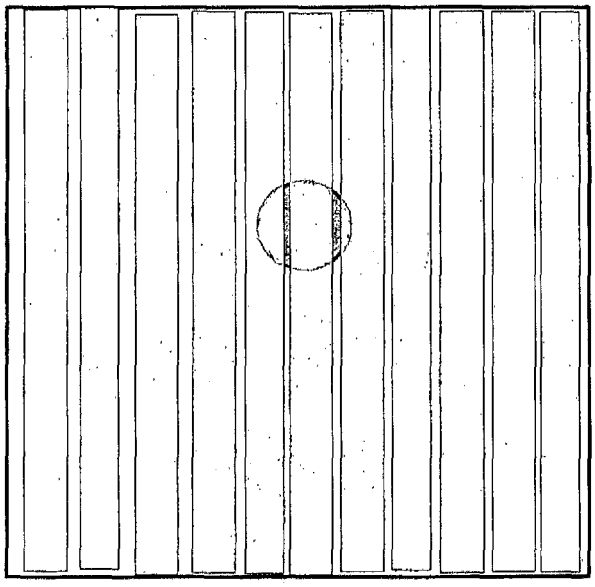
FIG. 14 shows a filter bag according to the invention with a longitudinally disposed diffuser (11×22 mm) (example 14).
Figure 15:
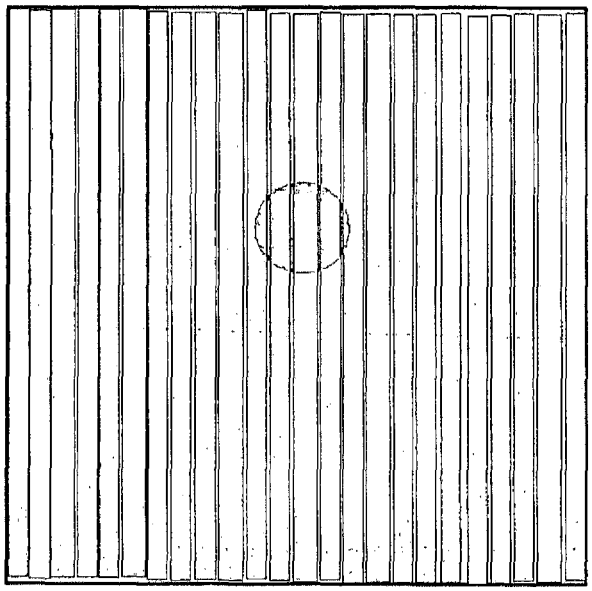
FIG. 15 shows a filter bag according to the invention with a longitudinally disposed diffuser (24×5 mm) (example 15).
Figure 16:
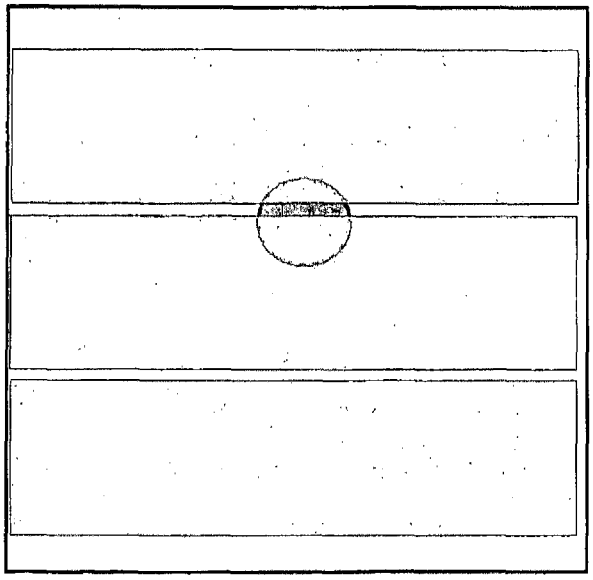
FIG. 16 shows a filter bag according to the invention with a transversely disposed diffuser (3×90 mm) (example 16).
Figure 17:
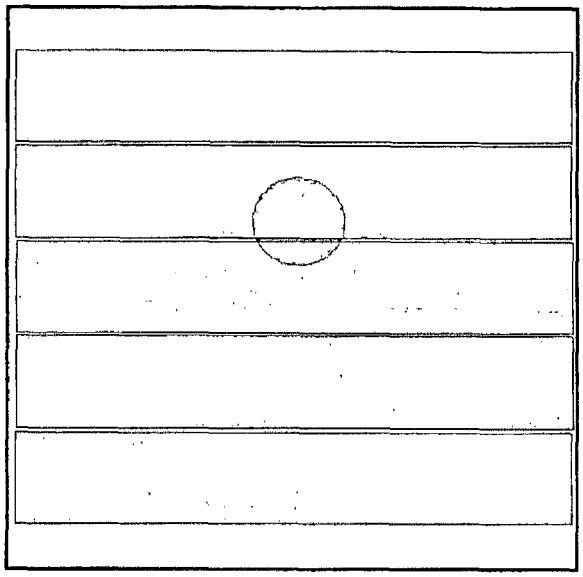
FIG. 17 shows a filter bag according to the invention with a transversely disposed diffuser (4×54 mm) (example 17).
Figure 18:
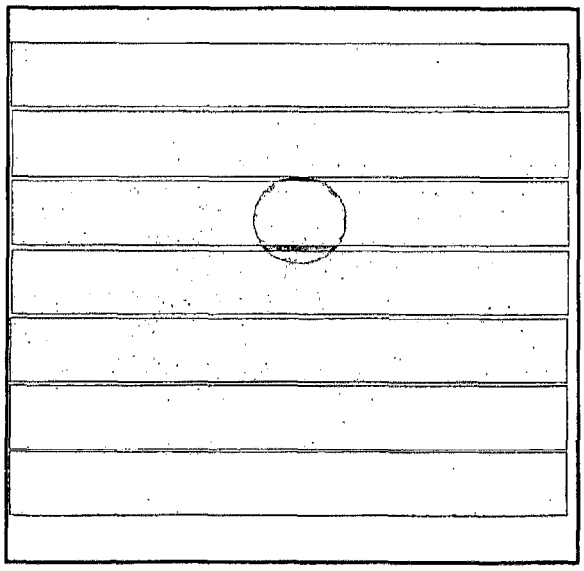
FIG. 18 shows a filter bag according to the invention with a transversely disposed diffuser (7×38 mm) (example 18).
Figure 19:
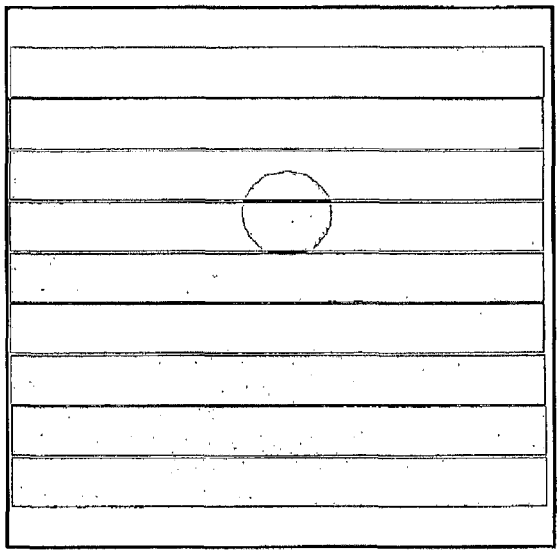
FIG. 19 shows a filter bag according to the invention with a transversely disposed diffuser (9×30 mm) (example 19).
Figure 20:
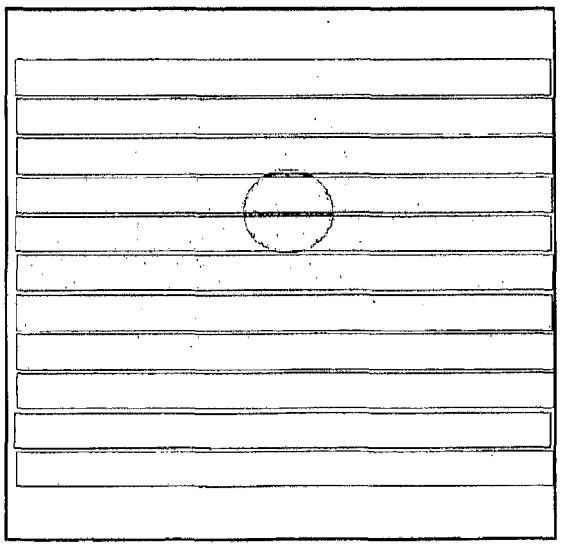
FIG. 20 shows a filter bag according to the invention with a transversely disposed diffuser (11×22 mm) (example 20).
Figure 21:
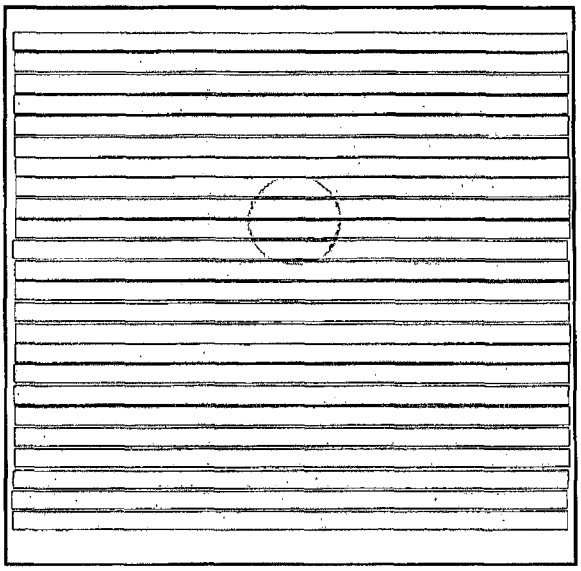
FIG. 21 shows a filter bag according to the invention with a transversely disposed diffuser (24×11 mm) (example 21).

The filter bags represented in FIGS. 1 to 21 (of the GN constructional type by the company Miele) were measured in a test series (implemented with a vacuum cleaner by Miele, type 5210) with defined quantities of DMT-standard dust type 8 (50-400 g, respectively in 50 g interval steps). For this purpose, reference is made to DIN EN-ISO 60312. The measurement values are indicated for the filter bags in Table 1. The two lower lines of the table respectively show the measured pressure loss in % after picking up 200 or 400 g DMT-standard dust, this value being determined by the measured pressure value after picking up the respective quantity of dust, relative to the measured pressure, in the case of the dust filter bag inserted in the vacuum cleaner without having previously picked up dust. Compared with the comparative examples 1* (dust filter bag without flow directors or diffusers, see FIG. 1) and 2* (filter bag with continuous nonwoven layer, see FIG. 2), a significant improvement in pressure decrease or pressure loss can be observed with all picked-up quantities of dust. In this respect, the dust filter bags according to the invention have a significantly increased lifespan or dust pick-up capacity relative to the filter bags according to comparative examples 1* and 2*. Compared with the filter bag of comparative example 3* known from the state of the art (see FIG. 3), for the most part likewise improved test results with respect to the dust storage capacity and lifespan can be established, whilst many filter bags according to the invention, with respect to the dust pick-up capacity and lifespan, are almost equal to the filter bag according to comparative example 3*. The filter bags according to the invention, relative to the filter bag according to comparative example 3*, always however offer the advantage that blockages in the region of the inlet opening can be almost completely avoided due to the very short-dimensioned flow director SR1 of the filter bag (see FIG. 3).

Figure 22:
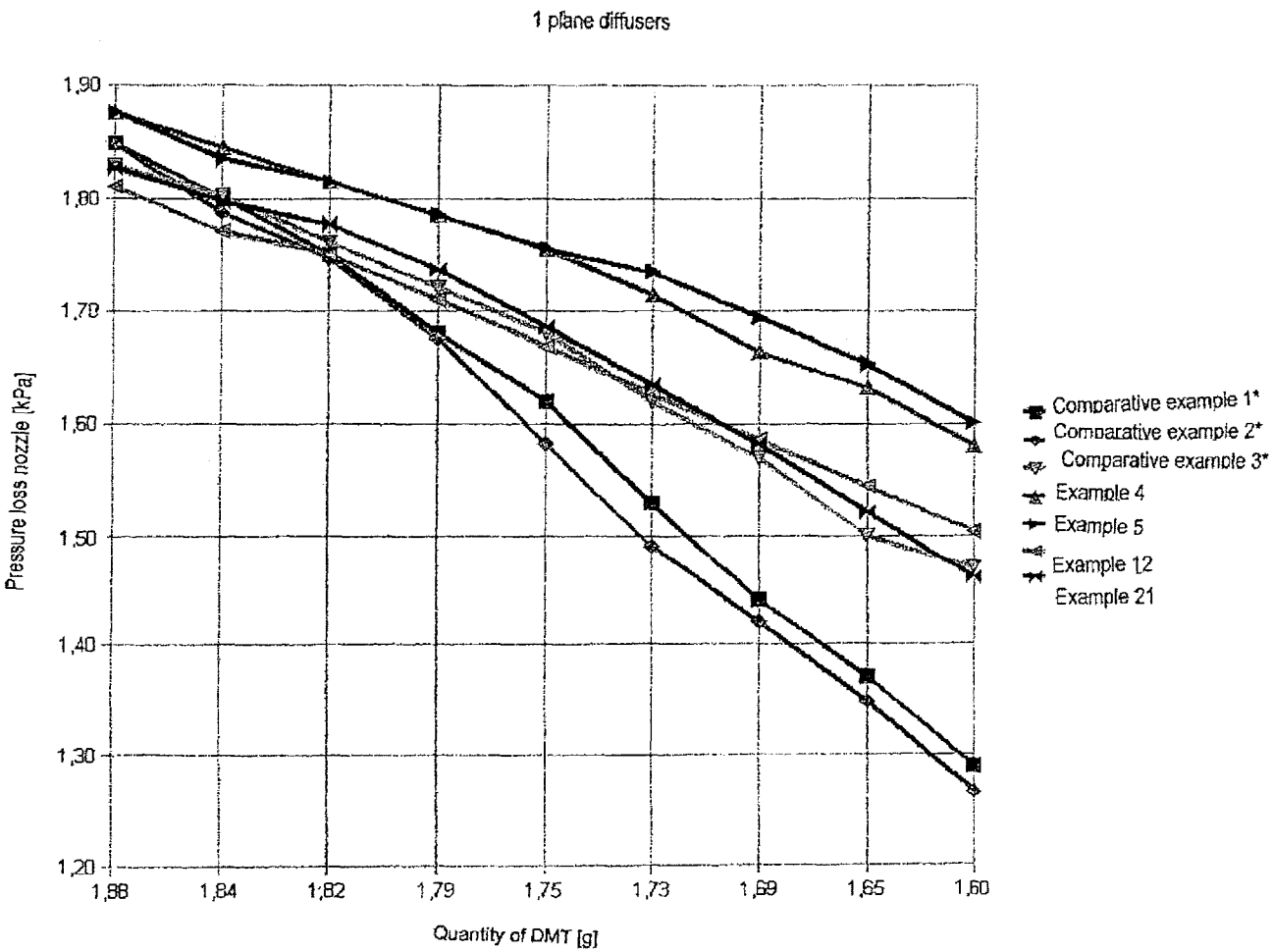
FIG. 22 shows selected test results with the filter bags according to the invention which are compared with the filter bags according to comparative examples 1* to 3*.

In FIG. 22, selected test results with the filter bags according to the invention are compared with the filter bags according to comparative examples 1* to 3*. In the diagram, a comparison of the obtained measurement values with comparative examples 1* to 3* takes place respectively. It can be detected clearly that the filter bags according to the invention are clearly superior to the filter bags according to the comparative examples 1* and 2* with respect to the pressure decrease in the case of a previously defined picked-up quantity of dust, whilst equal results or slight improvements can be observed with respect to the filter bag according to comparative example 3*. However, it is advantageous with the vacuum cleaner filter bags according to the invention, relative to those of comparative example 3*, that the filter bags according to the invention are less inclined to form blockages in the region of the inflow opening.

TABLE 1

| | Example No. | | | | | | | | | | |
|---|---|---|---|---|---|---|---|---|---|---|---|
| | 1* pressure [kPa] | 2* pressure [kPa] | 3* pressure [kPa] | 4 pressure [kPa] | 5 pressure [kPa] | 6 pressure [kPa] | 7 pressure [kPa] | 8 pressure [kPa] | 9 pressure [kPa] | 10 pressure [kPa] | 11 pressure [kPa] |
| Quantity of dust (g) | | | | | | | | | | | |
| 0 (without bag) | 1.90 | 1.90 | 1.90 | 1.92 | 1.92 | 1.91 | 1.88 | 1.84 | 1.88 | 1.88 | 1.88 |
| 0 | 1.85 | 1.85 | 1.83 | 1.88 | 1.88 | 1.85 | 1.81 | 1.79 | 1.83 | 1.82 | 1.81 |
| 50 | 1.80 | 1.79 | 1.80 | 1.85 | 1.84 | 1.81 | 1.79 | 1.76 | 1.77 | 1.78 | 1.79 |
| 100 | 1.75 | 1.75 | 1.76 | 1.82 | 1.82 | 1.77 | 1.77 | 1.72 | 1.74 | 1.76 | 1.75 |
| 150 | 1.68 | 1.67 | 1.72 | 1.79 | 1.79 | 1.73 | 1.74 | 1.67 | 1.69 | 1.71 | 1.71 |
| 200 | 1.62 | 1.58 | 1.68 | 1.75 | 1.75 | 1.69 | 1.70 | 1.62 | 1.64 | 1.65 | 1.68 |
| 250 | 1.53 | 1.49 | 1.62 | 1.71 | 1.73 | 1.66 | 1.66 | 1.56 | 1.59 | 1.62 | 1.61 |
| 300 | 1.44 | 1.42 | 1.57 | 1.66 | 1.69 | 1.57 | 1.60 | 1.49 | 1.52 | 1.57 | 1.57 |
| 350 | 1.37 | 1.35 | 1.50 | 1.63 | 1.65 | 1.52 | 1.55 | 1.44 | 1.46 | 1.51 | 1.50 |
| 400 | 1.29 | 1.27 | 1.47 | 1.58 | 1.60 | 1.47 | 1.48 | 1.36 | 1.40 | 1.45 | 1.43 |
| pressure loss | | | | | | | | | | | |
| after 200 g | 12% | 14% | 8% | 7% | 7% | 9% | 6% | 9% | 11% | 10% | 7% |
| after 400 g | 30% | 31% | 20% | 16% | 15% | 20% | 18% | 24% | 23% | 20% | 21% |

| | Example No. | | | | | | | | | |
|---|---|---|---|---|---|---|---|---|---|---|
| | 12 pressure [kPa] | 13 pressure [kPa] | 14 pressure [kPa] | 15 pressure [kPa] | 16 pressure [kPa] | 17 pressure [kPa] | 18 pressure [kPa] | 19 pressure [kPa] | 20 pressure [kPa] | 21 pressure [kPa] |
| Quantity of dust (g) | | | | | | | | | | |
| 0 (without bag) | 1.88 | 1.88 | 1.88 | 1.88 | 1.91 | 1.90 | 1.90 | 1.90 | 1.90 | 1.89 |
| 0 | 1.81 | 1.80 | 1.82 | 1.82 | 1.85 | 1.83 | 1.85 | 1.84 | 1.83 | 1.83 |
| 50 | 1.77 | 1.78 | 1.78 | 1.77 | 1.80 | 1.80 | 1.82 | 1.79 | 1.81 | 1.80 |
| 100 | 1.75 | 1.75 | 1.75 | 1.74 | 1.77 | 1.77 | 1.77 | 1.75 | 1.77 | 1.78 |
| 150 | 1.71 | 1.72 | 1.72 | 1.72 | 1.75 | 1.74 | 1.73 | 1.71 | 1.73 | 1.74 |
| 200 | 1.67 | 1.67 | 1.68 | 1.69 | 1.70 | 1.69 | 1.66 | 1.64 | 1.69 | 1.69 |
| 250 | 1.63 | 1.63 | 1.63 | 1.64 | 1.63 | 1.60 | 1.60 | 1.58 | 1.63 | 1.63 |
| 300 | 1.59 | 1.57 | 1.57 | 1.58 | 1.58 | 1.55 | 1.54 | 1.51 | 1.57 | 1.58 |
| 350 | 1.55 | 1.50 | 1.52 | 1.51 | 1.53 | 1.47 | 1.48 | 1.44 | 1.50 | 1.52 |
| 400 | 1.50 | 1.44 | 1.47 | 1.48 | 1.44 | 1.41 | 1.40 | 1.39 | 1.45 | 1.46 |
| pressure loss | | | | | | | | | | |
| after 200 g | 8% | 7% | 8% | 7% | 8% | 8% | 10% | 11% | 8% | 8% |
| after 400 g | 17% | 20% | 19% | 19% | 22% | 23% | 24% | 24% | 21% | 20% |

The invention claimed is:

1. A flat bag, comprising:

a bag upper side;

a bag underside;

an inlet opening, through which the air to be filtered enters, being introduced in the bag upper side; and at least one diffuser which forms an intermediate plane is disposed in the interior of the flat bag between the bag upper side and the bag underside, which diffuser consists of at least two individual strips of material disposed next to each other, which have oblong-shaped flow openings, wherein the at least one diffuser is connected to the bag walls on at least one side, and wherein bag walls are formed from an air-permeable filter material.

2. The flat bag according to claim 1, wherein there is excluded a diffuser in the form of sheet materials with oblong-shaped flow openings which is disposed in the region of the inlet opening and overlaps the latter and is mounted on the bag upper side, having an area of <10%, relative to the total bag surface, the width of the strips of material being defined by the diameter of the inlet opening ±50%.

3. The flat bag according to claim 1, wherein the strips of material are disposed moveably relative to each other.

4. The flat bag according to claim 1, wherein the strips of material are at a spacing relative to each other.

5. The flat bag according to claim 1, wherein the width of the strips of material is at least 2 mm and at most 50% of the width of the bag upper side.

6. The flat bag according to claim 1, wherein the oblong-shaped flow openings of the sheet materials are linear.

7. The flat bag according to claim 6, wherein the linear flow openings have at least one of a parallel configuration, a meandering configuration and a zigzag configuration.

8. The flat bag according to claim 6, wherein the linear, oblong flow openings have a different length.

9. The flat bag according to claim 1, wherein the diffuser is mounted on the bag wall on both sides.

10. The flat bag according to claim 1, wherein the diffuser has approximately at least one of the same length and the same width as the bag upper- or underside.

11. The flat bag according to claim 1, wherein the diffuser is at least one of narrower and shorter than the bag upper- or underside.

12. The flat bag according to claim 1, wherein the diffuser has at least one of a greater length and a greater width than the bag upper- or underside and is present folded.

13. The flat bag according to claim 1, wherein the diffuser in the form of strips of material is configured at least one of turned and twisted.

14. The flat bag according to claim 1, wherein the diffuser in the form of strips of material is formed by one of filament bundles and bundles of foil strips.

15. The flat bag according to claim 1, wherein at least two diffusers in the intermediate plane are disposed relative to each other such that at least one of the strips of material and the oblong flow openings are not disposed parallel to each other.

16. The flat bag according to claim 15, wherein the at least two diffusers are disposed orthogonally relative to each other.

17. The flat bag according to claim 15, wherein the at least two diffusers are disposed in an arrangement which deviates from the orthogonal one.

18. The flat bag according to claim 1, wherein the materials of the diffusers are formed from at least one of an air-permeable material and an air-impermeable material.

19. The flat bag according to claim 18, wherein the air-impermeable material is a foil.

20. The flat bag according to claim 18, wherein the air-permeable material is formed from at least one of a laminate of the air-permeable material and the air-impermeable materials provided with flow openings.

21. The flat bag according to claim 1, wherein the diffuser is connected to the bag wall via at least one of an adhesive point and a weld point.

22. The flat bag according to claim 1, wherein the flat bag is formed by two webs made of the filter material which are welded together in the edge region.

23. The flat bag according to claim 1, wherein the flat bag has one of a square shape, a hexagonal shape and a octagonal shape.

24. The flat bag according to claim 22, wherein the diffuser is connected to the edge region of the flat bag.

25. The flat bag according to claim 1, wherein the flat bag is a side-folded bag.

26. The flat bag according to claim 25, wherein the diffuser is connected to the side fold of the flat bag.

* * * * *